United States Patent [19]

Benham

[11] Patent Number: 4,746,022

[45] Date of Patent: May 24, 1988

[54] COLLAPSIBLE THREE DIMENSIONAL SUPPORT STRUCTURE

[76] Inventor: Junior H. Benham, 10045 NE. 17th, Bellevue, Wash. 98004

[21] Appl. No.: 17,489

[22] Filed: Feb. 24, 1987

[51] Int. Cl.[4] ..... A47F 5/00

[52] U.S. Cl. ..... 211/195; 211/196

[58] Field of Search ..... 211/195, 85, 104, 130, 211/132, 149, 167, 196; 248/529

[56] References Cited

U.S. PATENT DOCUMENTS

| | | | |
|---|---|---|---|
| 430,970 | 6/1890 | Reed | 211/196 X |
| 1,654,427 | 12/1927 | Modlarz | 211/196 |
| 2,035,874 | 3/1936 | Gage | 211/130 X |
| 4,406,437 | 9/1983 | Wright | 248/529 |

FOREIGN PATENT DOCUMENTS

| | | | |
|---|---|---|---|
| 79035 | 9/1951 | Norway | 211/205 |

*Primary Examiner*—Robert W. Gibson, Jr.
*Attorney, Agent, or Firm*—Harry M. Cross, Jr.

[57] ABSTRACT

A collapsible three dimensional support structure is provided which may be either free standing or adapted to hang from an overhead support. The structure has utility as an ornament or ornament support as well as general utility as a support rack. The structure includes a base formed from interfitting flat cross members which includes an upstanding central post member and a collapsible and expandable cover structure which mounts on the base. The cover structure is made of a single element comprising concentric rings connected by integral flexible connectors which permit the rings to be laterally separated along an axis normal to their common center point to form a conical framework. The cover element is placed over the upright post member and expanded along its longitudinal axis and connected to the top and bottom portions thereof to form a conical configuration. Interfitting flat decorative top pieces may be press fitted to the top end of the central post. A hanger element may also be provided which adapts the structure for hanging from an overhead surface.

7 Claims, 3 Drawing Sheets

COLLAPSIBLE THREE DIMENSIONAL SUPPORT STRUCTURE

BACKGROUND OF THE INVENTION

1. Field of the Invention

This invention relates to a collapsible three dimensional structure which is assembled from substantially flat flexible pieces. The structure has utility as a table top or hanging ornament or general support rack. The pieces interfit to form a base, a central upright post member, and a collapsible one piece covering which is mounted to and expanded over the central upright post and base to form an overall conical framework. The framework may serve as a general utility support rack or may be decorated or otherwise embellished to function as an ornament. One of the primary advantages of the invention is the provision of a three dimensionally stable structure which may be formed entirely from substantially flat elements which are adapted for convenient storing or packaging. A collapsible and expandable cover member for the upright post may be made from a single piece of material such as medium soft durable plastic molded into concentric rings connected by flexible connector members.

2. Description of the Related Art

In the prior art, many attempts have been made to provide artificial Christmas trees and the like and other ornamental objects as well as various types of display or support racks which are assembled from precut or preformed parts. Most such attempts have resulted in either complex and cumbersome devices or rather unattractive and oversimplified structures which lack true three dimensional shape and/or structural stability for the purpose intended. Another drawback of the prior art devices such as artificial Christmas trees or ornaments of various types is the use of component members which are either too bulky for safe packaging or which are so complex and fragile that they are easily broken and relatively expensive to manufacture. The features of easy assembling, packaging and storing from season to season is very important in such items.

SUMMARY OF THE INVENTION

The present invention provides a free standing or overhead supported collapsible structure for use as a support rack or the like or for ornamental purposes which is three dimensionally stable, reusable and simplified in its component parts. A central support structure is provided which comprises an elongated upright post member and a multiple-leg base. The post member and base member also serve as attachment means for an expandable cover. The generally conical shaped cover or framework is provided by a flat disc which has been formed into multiple concentric rings connected by integral connectors. The connectors permit the rings to be separated laterally along an axis normal to their common center point so as to expand the flat disc to form the conical shaped cover. This cover is connected at its center point to one end of the central support structure and at the outside ring to the other end of the central support structure so as to hold it in the extended position. When used as an ornamental support, the top end of the conical cover may be provided with ornamentation or with a hanger device or both when used in the hanging mode. In the disassembled condition the device may be reduced to substantially three or four main elements which are relatively flat to facilitate storage or packaging.

DESCRIPTION OF THE PREFERRED EMBODIMENTS

Figure 1:
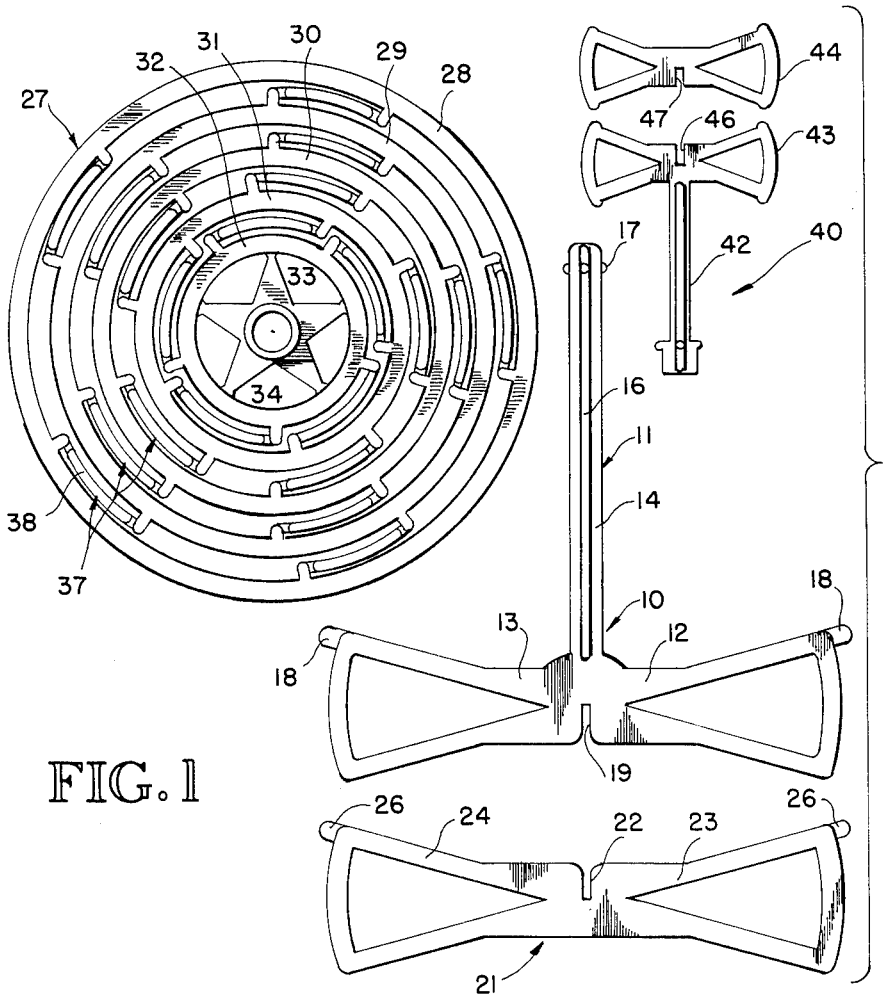
FIG. 1 is a view showing the disassembled elements in a group which form the preferred embodiment of the invention in the knockdown condition ready for packaging.
Figure 3:
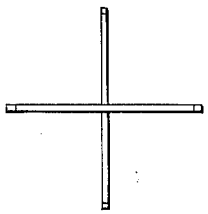
FIG. 3 is a top plan view of the top ornamentation unit shown in FIG. 1.

FIG. 1 is a collective view showing the five generally flat pieces which form the three dimensional structure when assembled. The central upright support for the structure is provided by the main support element 10 which includes the post 11 and a bottom cross arm comprising the two leg members 12 and 13 all of which may be integral in construction. The central support member 10 as well as remaining parts of the construction are preferably formed from a moldable plastic which is substantially flexible yet rigid enough to be self supporting. The plastic material from which the members are molded may be varied within a wide range of available plastics known to the art depending on the purpose for which the structure is intended. It is conceivable that other materials may be utilized depending upon the desired results.

Figure 2:
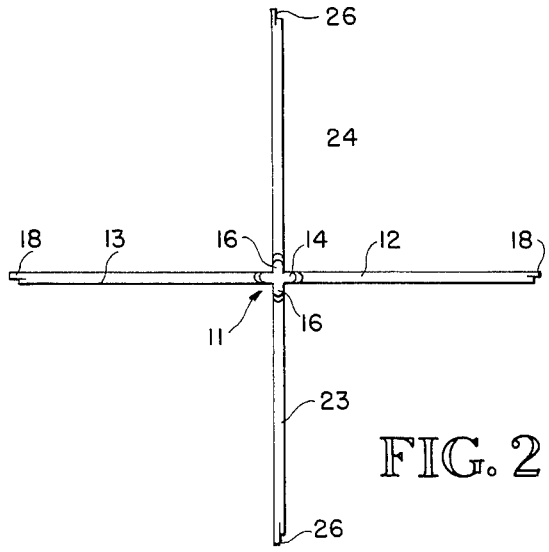
FIG. 2 is a top plan view of the central upright support member with the base arms in engagement.

As shown in plan view in FIG. 2, the central post 11 has a generally flat web 14 with identical ribs 16 formed on either side and extending substantially the full length thereof so as to form a symmetrical cross section post. The thickness of the material of the central support element 10 will be chosen, of course, so as to provide sufficient vertical support for whatever use is intended for the structure. The side edges of the upper end of the web 14 and the ribs 16 are provided with knobs or protrusions 17 to enable the mounting of the collapsible cover structure in a manner presently to be described. The leg members 12 and 13 may be made in a variety of configurations, the present embodiment being that of bows seen in side elevation with the bottom sides of the legs being suitable for engagement with a surface such as a table top. The outside corners of each of the top edges of the legs 12 and 13 are provided with identical protrusions 18, again for the purpose of attaching the collapsible covering in a manner presently to be described. The central portion of the bottom edge of the legs 12 and 13 is provided with a notch or slot 19 for receiving a cross member 21 which has a corresponding notch 22. The cross member 21 may have the legs 23 and 24 thereof substantially identical to the legs 12 and 13 and include the protrusions 26 on the outer corners of the upper edges corresponding to the protrusions 18.

Figure 4:
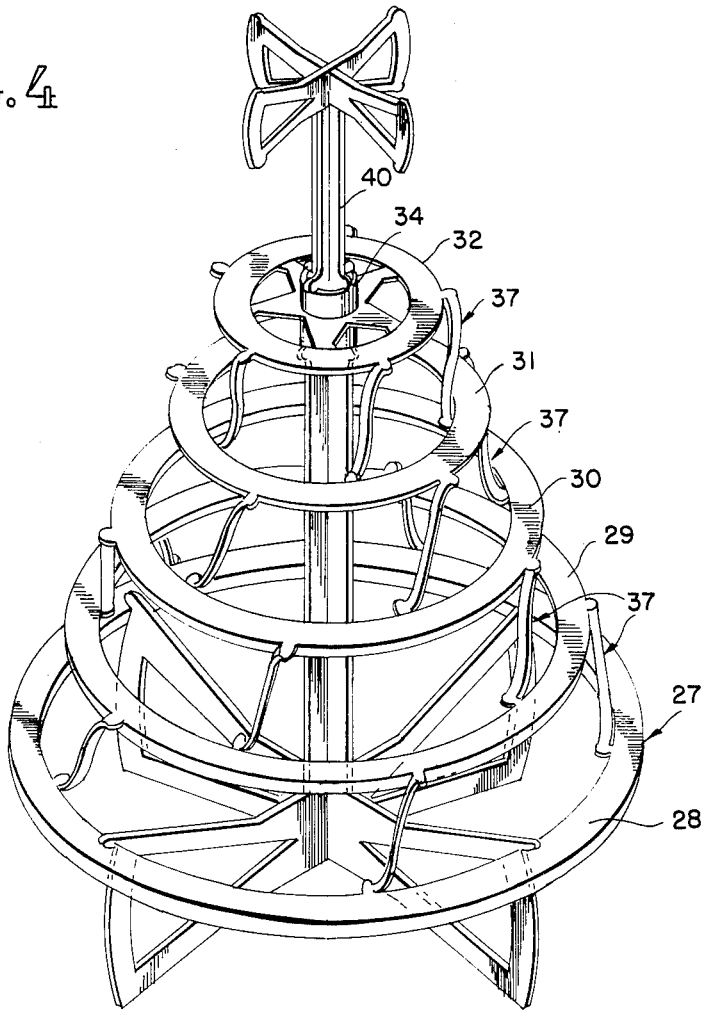
FIG. 4 is a perspective view of the parts shown in FIG. 1 assembled to form the three dimensional unit.

In the assembled position as shown in FIGS. 2 and 4, the legs 12-13 and 23-24 comprise the support base for the upright post 11 when the structure is utilized as a free standing unit.

The collapsible and expandable cover structure 27 which mounts on the support element 10 is a molded unitary element in the present embodiment. The cover is shown in plan view in its flattened or collapsed position in FIG. 1 and in the conical expanded position mounted on the central support element in FIG. 4. In its relaxed or collapsed position shown in FIG. 1, the cover structure takes the form of a substantially flat disc made up of interconnected concentric rings. The disc 27 may be formed from the same plastic material used for the main support elements described and, in the embodiment disclosed, is made of a single monolithic molding. All of the parts to be described are understood to be integral and are all of the same material. In the alternative the disc member could be formed by other processes such as stamping, cutting or forming in any other manner such that all of the parts are connected and are flexible and/or pivotable in the manner to be described.

In the present embodiment, five concentric rings 28–32 are provided. In the flat position shown in FIG. 1, spacing is provided between each ring to allow for the formation of five sets of connector elements presently to be described. The central ring 32 is provided with a spanner structure 33 in the shape of a star in the present embodiment. The spanner 33 is, of course, integral with the ring 32 and includes a hub 34 extending in both directions from the surface of the spanner 33. A cylindrical channel 36 is provided in the hub for the reception of the upper end of the main support element 10 as shown in detail in FIG. 5. With this arrangement, the hub 34 is seated on the knobs 27 and centers the disc 27 relative to the support element.

Figure 6:
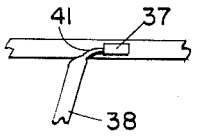
FIG. 6 is an elevational detail showing a formation of the connection between the concentric rings and the flexible connectors.

As shown in FIGS. 1 and 4, a set of five flexible connector arms are located between each successive concentric ring 28–32. These connector elements 37 are equidistantly spaced about the circumference of each successive ring. These connector elements are molded integrally with the successive rings and are flexible allowing each ring to be laterally offset from the adjacent rings. As seen in FIGS. 1 and 4, the connector elements 37 are elongated curved straplike members having the same radius of curvature as the adjacent rings, and in the present embodiment, are all of substantially the same length. Since there are five consecutive concentric rings, there are four sets of connector elements 37. The elongated body portion 38 of each strap is connected at each end to a respective one of the adjacent concentric rings by an end tab 39 and a connector segment 41 of reduced cross sectional area relative to the elongated body 38. With reference to FIG. 6 it will be appreciated that the elongated body 38 of the connector is of reduced cross section relative to the adjacent concentric rings and the connector segments 41 are even further reduced in cross section. The reduced cross section of the elongated body 38 permits the connector element to assume a somewhat S-shaped configuration when the rings are laterally separated with the resultant inherent rotation between the concentric rings which permits the expansion of the flat discs into the conical shaped cover structure illustrated in FIG. 4. The reduced cross sectional area of the connector segments 41 is designed to reduce the bending stress in the flexible material of the connector elements.

Figure 5:
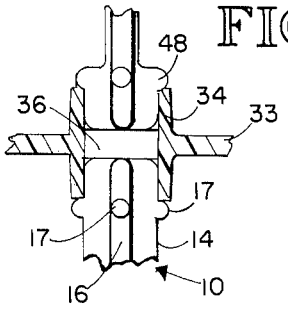
FIG. 5 is a partially sectioned view showing the engagement between the expandable cover or frame, the central support member and the top ornamentation unit.

In order to assemble the structure, the cross member 21 is fitted to the bottom end of the main support element 10 with the slot 22 engaging the slot 19 such that the cross member 21 is at right angles to the legs 12 and 13 as shown in FIGS. 2 and 4. The cover structure comprising the segmented disc 27 is placed on top of the post 11 with the upper end of the post engaged in the hub channel 36 as shown in FIG. 5 allowing the segmented disc to rest on the protrusions 17 of the post. The outermost ring 28 is pulled downwardly to expand the disc by laterally separating the rings along an axis normal to their common center point to form the conical cover. As aforementioned, the rings will rotate relative to one another to permit the separation. The bottom ring 28 is engaged over the four protrusions 18 and 26 on the legs 12-13 and the cross member 21 respectively to hold the bottom ring 28 in engagement with the base of the main support element as shown in FIG. 4.

With the structure assembled as shown in FIG. 4, the upstanding top side of the hub 34 provides a receptacle for the placement of an ornament or top piece 40 for the structure. In the present embodiment, the ornament comprises the elongated shaft 42 which may be ribbed in the manner described for the post 11 for the purpose of rigidity. The top piece 40 may be made of the same molded material as the rest of the structure with any ornamental configuration such as the bow 43 formed integral therewith and the second bow 44 designed to interfit with the first bow by means of the slots 46 and 47 respectively. The bottom end of the shaft 42 will be molded to include the knobs or protrusions 48 which aid in stabilizing the shaft 42 when the bottom end is inserted in the upper part of the hub 34 shown in FIG. 5. It will be understood that the present configuration of top piece for the structure may be varied in appearance depending upon the use to which the structure is accommodated. The present configuration is representative of a miniature Christmas tree which may be further decorated. The FIG. 4 embodiment is designed, of course, to set on the surface of a table or other structure.

Figure 7:
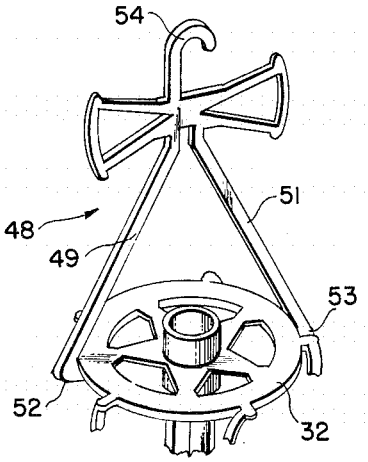
FIG. 7 is a view of a top ornamentation element which may also be utilized as a hanger attachment in the event the device is suspended from overhead.

In the event that the structure is intended for utility as a hanging object, the top decorative member 40 may be removed and a hanger structure indicated generally at 48 in FIG. 7 substituted therefore. The embodiment of the hanger structure shown in FIG. 7 includes the diverging legs 49 and 51 which may be identical, the gripping elements 52 and 53 respective for the legs, and a hook 54 molded on the upper end of the legs. The hook 54 will serve to suspend the structure from an overhead attachment with the gripping elements 52-53 being spread apart to engage the top ring 32 as illustrated in FIG. 7. The natural resiliency of the molded plastic material will hold the gripping elements in engagement with the top ring 32 when placed at substantially diametrically opposite points of contact. Any form of decorative embellishments such as the integrally molded bow illustrated may also be provided on the hanging structure 48. As will be understood from the foregoing, description, a three dimensional collapsible structure of varied utility and simplified construction is provided by the present invention. The elements which comprise the three dimensional structure may be reduced to substantially flat pieces for easy storage and packaging and may be formed from moldable material with substantial durability such as many of the well known plastics available in the art. The device has particular utility and appeal when utilized as a hanging or table top ornament such as a miniature Christmas tree since the configuration of the spaced rings and the overall conical shape permit further ornamentation which is traditional with such items. Since the structure may be constructed of substantially durable plastic material and easily stored, it is capable of repeated use which constitutes an advantage in such items. Additionally, since the expandable concentric ring cover structure may be made of a single molding and is extremely simple in structure the device is inexpensive to manufacture.

Although the present invention has been described with respect to a preferred embodiment, modifications to the disclosed embodiment or its use in a different setting is well within the scope of the invention.

What is claimed is:

1. A collapsible three dimensional structure comprising;

a base including an upright post member with a free end and laterally extending legs at the opposite end thereof, said leg members comprising a first cross arm formed integrally with said post forming diametrically extending first legs and a second cross arm forming diametrically extending second legs, said first and second cross arms including notch means for press fitting said arms into engagement to form said base;

a cover framework comprising a disc having a plurality of radially spaced concentric rings, elongated flexible connector means connected between each concentric ring, said connector means being constituted and arranged to permit the concentric rings to be separated by displacement axially along an axis normal to their common center point and rotated to form a conically shaped framework; and means for connecting the center most ring of said disc to the free end of said upright post and the outermost ring to said legs comprising first attachment means on said legs for engaging and retaining the outermost ring of said disc, and second retaining means on the free end of said post member and the innermost ring of said disc for securing said innermost ring to the post, whereby said disc may be expanded and supported by said base and the innermost ring may be secured to the free end of said post, said rings separated axially along an axis normal to their common center point, and the outermost ring engaged with said legs to form said conical shaped framework.

2. A collapsible three dimensional structure comprising;

a base including an upright post member with a free end and laterally extending legs at the opposite end thereof; a cover framework comprising a disc having a plurality of radially spaced concentric rings comprising a flexible monolithic structure, elongated flexible connector means connected between each concentric ring comprising a plurality of curved segments located between and equidistantly spaced about the circumferance of adjacent rings, each said segment being connected at its opposite ends only to respective adjacent rings, whereby said segments being constituted and arranged to deflect to permit the concentric rings to be separated by displacement axially along an axis normal to their common center point and rotated to form a conically shaped framework; and means for connecting the center most ring of said disc to the free end of said upright post and the outermost ring to said legs, whereby said disc may be expanded and supported by said base.

3. The combination according to claim 2 wherein said segments are of reduced cross-section relative to said rings.

4. The combination according to claim 3 wherein each said reduced cross-section segment includes a bendable area adjacent each end thereof of reduced cross-section relative to the remaining portion of the segment, whereby bending stress in the body of said segment is relieved.

5. The combination according to claim 1 wherein said second retaining means comprises;

hub means connected to said innermost ring, said hub means including a central cylindrical through passage concentric with said ring, and protrusions on said post member spaced from the free end thereof, the free end of said post being engageable in said passage and said hub engaging said protrusions when said rings are separated and displaced toward the base.

6. The combination according to claim 5 including a top piece adapted for engagement with said hub, said top piece including a shaft having an end portion adapted to engage said cylindrical passage, and means spaced from the terminal end of said shaft for engaging said hub to secure said top piece.

7. The combination according to claim 6 including attachment means for suspending said structure from an overhead support comprising;

a support engaging element, a body element including resilient ring engaging arms adapted to supportingly engage said innermost ring, said arms having a normal position and a spread position for engaging said innermost ring, said attachment means comprising a unitary molded material.

* * * * *